US008627805B2

(12) United States Patent
Perr et al.

(10) Patent No.: US 8,627,805 B2
(45) Date of Patent: Jan. 14, 2014

(54) SYSTEM AND APPARATUS FOR CONTROLLING REVERSE FLOW IN A FLUID CONDUIT

(75) Inventors: J. Victor Perr, Greenwood, IN (US); John T. Carroll, III, Columbus, IN (US)

(73) Assignee: Cummins Inc., Columbus, IN (US)

( * ) Notice: Subject to any disclaimer, the term of this patent is extended or adjusted under 35 U.S.C. 154(b) by 286 days.

(21) Appl. No.: 12/748,384

(22) Filed: Mar. 27, 2010

(65) Prior Publication Data

US 2011/0232615 A1 Sep. 29, 2011

(51) Int. Cl.
*F02M 25/07* (2006.01)

(52) U.S. Cl.
USPC ..... 123/568.12; 123/568.18

(58) Field of Classification Search
USPC ..... 123/698, 536, 539, 543, 545–549, 552, 123/556–557, 568.12, 568.16, 568.18, 590, 123/593; 60/296, 303–304, 320; 137/535; 251/42, 82–83, 126, 226, 227
See application file for complete search history.

(56) References Cited

U.S. PATENT DOCUMENTS

| | | | | | |
|---|---|---|---|---|---|
| 117,853 | A | | 8/1871 | Allen | |
| 960,080 | A | | 5/1910 | Fay et al. | |
| 1,167,386 | A | * | 1/1916 | Crusius | 48/189.4 |
| 1,395,932 | A | * | 11/1921 | Staude | 137/479 |
| 2,416,110 | A | | 2/1947 | Mallory | |
| 2,630,325 | A | | 3/1953 | Reynolds | |
| 2,646,063 | A | * | 7/1953 | Hayes | 137/218 |
| 2,728,550 | A | | 12/1955 | Sinkler | |
| 2,991,885 | A | | 7/1961 | Gutkowski | |
| 3,171,423 | A | * | 3/1965 | Dillon | 137/218 |
| 3,276,664 | A | | 10/1966 | Johnson | |
| 3,421,544 | A | | 1/1969 | Bozoyan | |
| 3,447,862 | A | * | 6/1969 | Elpern | 359/230 |
| 3,610,279 | A | * | 10/1971 | McIntosh et al. | 137/576 |
| 3,703,913 | A | * | 11/1972 | Carsten | 137/601.2 |
| 3,868,991 | A | | 3/1975 | Sheppard | |
| 3,877,304 | A | | 4/1975 | Vetsch | |
| 3,957,083 | A | * | 5/1976 | Gallo | 138/43 |
| 4,134,377 | A | | 1/1979 | Bamsey et al. | |

(Continued)

FOREIGN PATENT DOCUMENTS

| | | | |
|---|---|---|---|
| EP | 1 426 603 A1 | | 6/2004 |
| JP | 2008-190337 | * | 8/2008 |
| JP | 2010-144700 | * | 7/2010 |
| WO | 2008015397 | | 2/2008 |

OTHER PUBLICATIONS

International Searching Authority. International Search Report and Written Opinion. Cummins, Inc. PCT/US2011/030111, May 27, 2011.

*Primary Examiner* — Hai Huynh
(74) *Attorney, Agent, or Firm* — Krieg DeVault LLP

(57) ABSTRACT

A system includes an internal combustion engine receiving intake air from an intake manifold and providing exhaust gases to an exhaust manifold. The system further includes an exhaust gas recirculation (EGR) conduit fluidly coupling the exhaust manifold to the intake manifold. The system includes a conical spring check valve disposed in the EGR conduit, the conical spring check valve having a helically wound spring including a number of turns of decreasing diameter, where each turn progresses axially in a normal flow direction of the EGR from a previous one of the turns. Each of the turns further overlaps a previous one of the turns.

19 Claims, 4 Drawing Sheets

(56) References Cited

U.S. PATENT DOCUMENTS

| | | | | | |
|---|---|---|---|---|---|
| 4,138,849 | A | | 2/1979 | Wilber | |
| 4,258,687 | A | | 3/1981 | Mauch et al. | |
| 4,445,475 | A | | 5/1984 | Baumgartner et al. | |
| 4,526,004 | A | | 7/1985 | French et al. | |
| 4,554,943 | A | | 11/1985 | Claney et al. | |
| 4,976,279 | A | * | 12/1990 | King et al. | 137/107 |
| 5,044,395 | A | * | 9/1991 | Vadasz | 137/512.1 |
| 5,067,319 | A | | 11/1991 | Moser | |
| 5,172,717 | A | | 12/1992 | Boyle et al. | |
| 5,303,738 | A | * | 4/1994 | Chang et al. | 137/852 |
| 5,335,862 | A | * | 8/1994 | Esper | 239/570 |
| 5,419,685 | A | | 5/1995 | Fujii et al. | |
| 5,617,726 | A | * | 4/1997 | Sheridan et al. | 60/605.2 |
| 5,937,834 | A | * | 8/1999 | Oto | 123/568.18 |
| 6,276,664 | B1 | | 8/2001 | Keller | |
| 6,470,864 | B2 | * | 10/2002 | Kim et al. | 123/568.12 |
| 6,647,971 | B2 | | 11/2003 | Vaughan et al. | |
| 6,726,174 | B2 | | 4/2004 | Bareis et al. | |
| 6,976,480 | B2 | * | 12/2005 | Miyoshi et al. | 123/568.12 |
| 7,014,557 | B2 | | 3/2006 | Thomassin et al. | |
| 7,182,075 | B2 | | 2/2007 | Shahed et al. | |
| 7,284,544 | B2 | * | 10/2007 | Hatano | 123/568.12 |
| 7,287,378 | B2 | * | 10/2007 | Chen et al. | 60/605.2 |
| 7,357,125 | B2 | * | 4/2008 | Kolavennu | 123/568.11 |
| 7,363,919 | B1 | | 4/2008 | Styles | |
| 7,399,169 | B2 | * | 7/2008 | Nakamura | 417/441 |
| 7,762,242 | B2 | * | 7/2010 | Gates et al. | 123/568.18 |
| 7,987,836 | B2 | * | 8/2011 | Kurtz et al. | 123/568.12 |
| 8,042,565 | B2 | * | 10/2011 | Ball et al. | 137/218 |
| 8,307,650 | B2 | | 11/2012 | Robinson et al. | |
| 8,316,829 | B2 | * | 11/2012 | Piper et al. | 123/568.21 |
| 2004/0074480 | A1 | | 4/2004 | Chen et al. | |
| 2005/0189343 | A1 | | 9/2005 | Griffin et al. | |
| 2007/0068500 | A1 | | 3/2007 | Joergl et al. | |
| 2007/0125081 | A1 | | 6/2007 | Czarnowski et al. | |
| 2007/0144170 | A1 | | 6/2007 | Griffith | |
| 2008/0257316 | A1 | | 10/2008 | Modien et al. | |
| 2010/0024416 | A1 | * | 2/2010 | Gladden et al. | 60/605.2 |
| 2010/0051001 | A1 | | 3/2010 | Webb et al. | |
| 2011/0232789 | A1 | | 9/2011 | Perr et al. | |
| 2012/0000186 | A1 | * | 1/2012 | Aketa et al. | 60/275 |

* cited by examiner

SYSTEM AND APPARATUS FOR CONTROLLING REVERSE FLOW IN A FLUID CONDUIT

BACKGROUND

The technical field generally relates to control of reverse flow in engine related gaseous fluid conduits. Control of reverse flow in engine related gaseous fluid conduits is desirable for various reasons, including but not limited to meeting emissions and/or performance expectations. For example, where the engine related gaseous fluid conduit is an EGR fluid conduit, reverse flow places relatively cool fresh air into the EGR fluid conduit. The cool fresh air may cause condensation in the EGR fluid conduit, and the fresh air upon reversal may cause the combustion mixture to have more oxygen in a transient condition than is expected and desirable to meet emissions. Other examples of engine related fluid conduits where reverse flow is undesirable include, without limitation, a compressor bypass, an intercooler bypass, an EGR cooler bypass, a turbine bypass, and/or an aftertreatment bypass. Check valves are presently available to provide protection from reverse flow.

Presently available check valves may introduce a significant pressure drop in the intended flow direction making controls more difficult and less responsive. Further, presently available check valves do not operate well in the high temperature environments of many engine applications, and are further vulnerable to corrosion or undesirable physical phenomenon (e.g. sticking and/or gumming up) in the presence of combustion byproducts and/or unburned fuel. Therefore, further technological developments are desirable in this area.

SUMMARY

One embodiment is a unique check valve system for use in internal combustion engine gaseous fluid conduits. Further embodiments, forms, objects, features, advantages, aspects, and benefits shall become apparent from the following description and drawings.

DESCRIPTION OF THE ILLUSTRATIVE EMBODIMENTS

Figure 1:
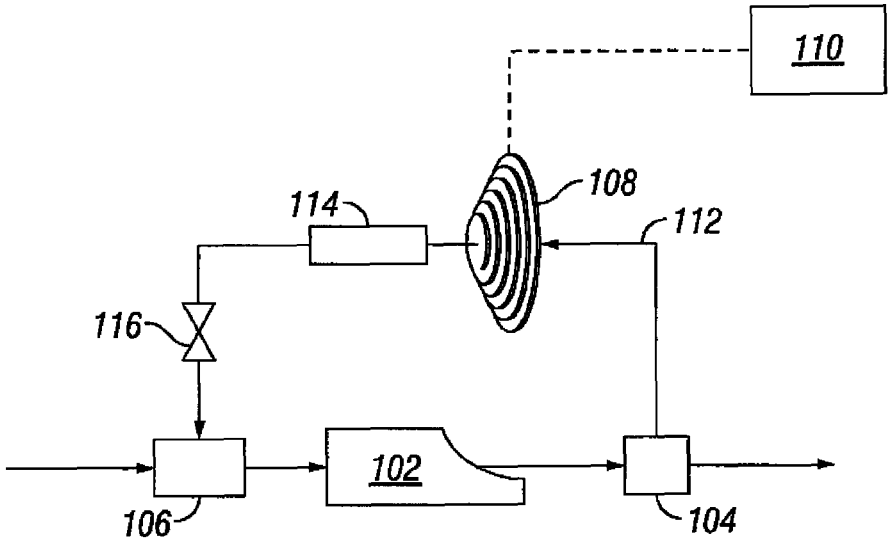
FIG. 1 is a schematic diagram of a system for controlling reverse flow in a fluid conduit.

For the purposes of promoting an understanding of the principles of the invention, reference will now be made to the embodiments illustrated in the drawings and specific language will be used to describe the same. It will nevertheless be understood that no limitation of the scope of the invention is thereby intended, any alterations and further modifications in the illustrated embodiments, and any further applications of the principles of the invention as illustrated therein as would normally occur to one skilled in the art to which the invention relates are contemplated herein.

FIG. 1 is a schematic diagram of a system for controlling reverse flow in a fluid conduit 112. The system includes an internal combustion engine 102 receiving intake air from an intake manifold 106 and providing exhaust gases to an exhaust manifold 104. The system further includes the fluid conduit 112 as an exhaust gas recirculation (EGR) conduit 112 fluidly coupling the exhaust manifold 104 to the intake manifold 106, and a conical spring check valve 108 disposed in the EGR conduit 112. The fluid conduit 112 is illustrated as an EGR conduit 112 in the exemplary system, but the fluid conduit 112 may be any fluid conduit understood in the art, including compressor bypass, an intercooler bypass, an EGR cooler bypass, a turbine bypass, and/or an aftertreatment bypass. In certain embodiments, the fluid conduit 112 is any engine related gaseous fluid conduit having combustion byproduct gases comprising at least a portion of the gases therein.

Figure 2A:
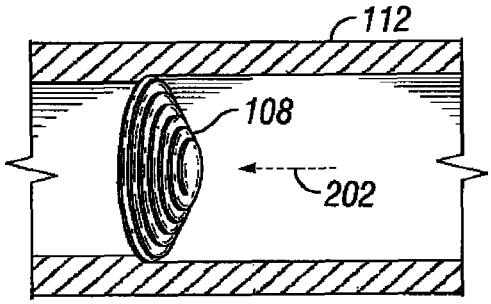
FIG. 2A is a schematic diagram of a conical spring check valve for controlling reverse flow in a fluid conduit having fluid pressure in the reverse flow direction.
Figure 2B:
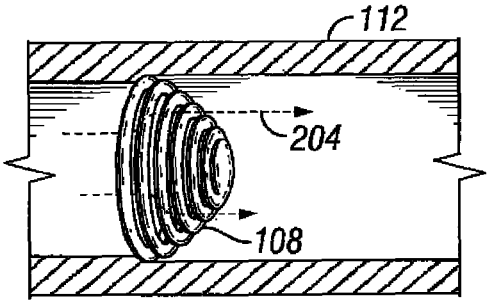
FIG. 2B is a schematic diagram of a conical spring check valve for controlling reverse flow in a fluid conduit having fluid pressure in the normal flow direction.

Referencing FIG. 2A, the conical spring check valve 108 further includes a helically wound spring having a plurality of turns of decreasing diameter, where each of the turns progresses axially in a normal flow direction of the EGR (flow 204, reference FIG. 2B) from a previous one of the turns, and where each of the turns at least partially radially overlaps the previous one of the turns. The conical spring check valve 108 thereby blocks or substantially blocks reverse flow when the fluid pressure would otherwise cause reverse flow 202 in the fluid conduit 212.

The conical spring check valve 108 may be positioned on an upstream side of an EGR cooler 114 as shown in the system of FIG. 1, and in an alternate embodiment may be downstream of an EGR valve 116 although the system of FIG. 1 has an EGR valve 116 on the cool side of the EGR conduit 112 (i.e. downstream of the EGR cooler 114). In alternate embodiments, the conical spring check valve 108 may be positioned downstream of the EGR cooler 114, and/or downstream of the EGR valve 116. Certain embodiments may include multiple conical spring check valves 108, positioned within the fluid conduit 112 wherever reverse flow is undesirable.

The system further includes a controller 110 that executes certain operations related to the conical spring check valve 108. The controller 110 is illustrated as a single computing device, but the controller 110 can include one or more computers, and/or hard-wired elements in hardware. Exemplary operations of the controller 110 include heating the helically wound spring of the conical spring check valve 108 to prevent condensation on the spring, to clean the spring, and/or to control a spring rate of the spring. Further exemplary operations of the controller 110 include commanding a valve restriction actuator to control a function of an effective flow area of the conical spring check valve 108 versus a flow rate through the conical spring check valve. More detailed operations of an exemplary controller 110 are provided in the description below referencing FIG. 6.

Figure 5:
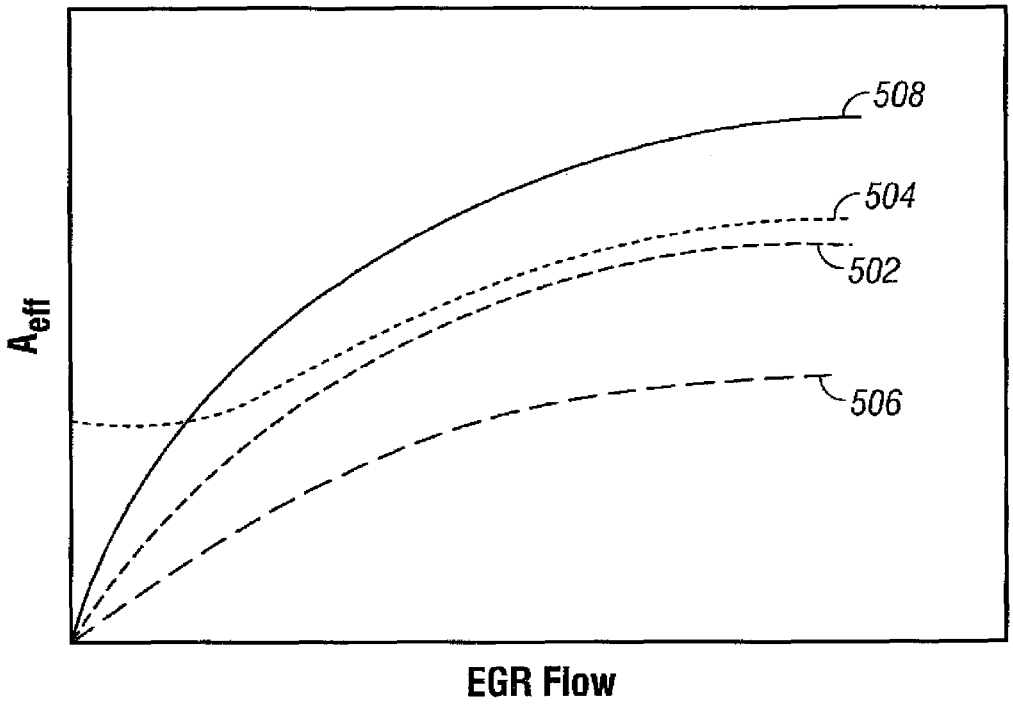
FIG. 5 is an illustration of a plurality of functions of an effective flow area versus a gas flow rate.

The conical spring check valve 108 includes a first function of an effective flow area versus an EGR flow rate. For example, referencing FIG. 5, the curve 502 represents a nominal function of effective flow area versus EGR flow for an illustrative conical spring check valve 108. The actual function of effective flow area versus EGR flow for a given embodiment of the conical spring check valve 108 varies with the specific characteristics of the given embodiment, and is readily determined by interpreting data points from the specific embodiment.

Figure 3:
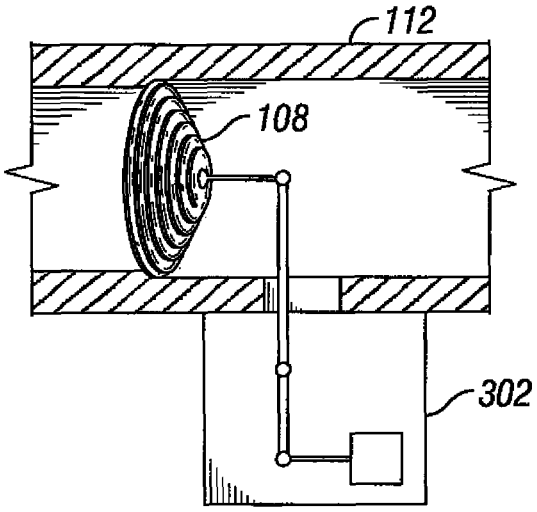
FIG. 3 is a schematic diagram of a valve restriction actuator that adjusts the conical spring check valve to a second function of an effective flow area versus a gas flow rate.

Referencing FIG. 3, a system includes a valve restriction actuator 302 that adjusts the conical spring check valve 108 to a second function of an effective flow area versus a gas flow rate. The valve restriction actuator 302 may apply an opening or closing axial force on the conical spring check valve 108, and may further hold the conical spring check valve 108 in a fixed selected position. Referencing FIG. 5, the curve 504 represents an exemplary second function of the effective flow area versus the gas flow rate where the valve restriction actuator 302 applies an opening force on the conical spring check valve 108. The curve 504 exhibits an effective flow area even at zero flow, with a slightly higher flow rate across the curve 504 versus the nominal curve 502. The valve restriction actuator 302 may apply whatever function of effective flow area versus flow rate is desired, and may operate only in selected operating conditions. Exemplary non-limiting operations include enhancing the effective flow area at low flow operations, enhancing the effective flow area during transient operations (to improve response where response is the predominant consideration), and/or reducing the effective flow area during transient operations (to reduce reverse flow where reverse flow is the predominant consideration and/or where transient operation is a primary operating condition that causes reverse flow). The actuator 302 may be of any type known in the art, including at least electrical, pneumatic, and hydraulic.

Figure 4:
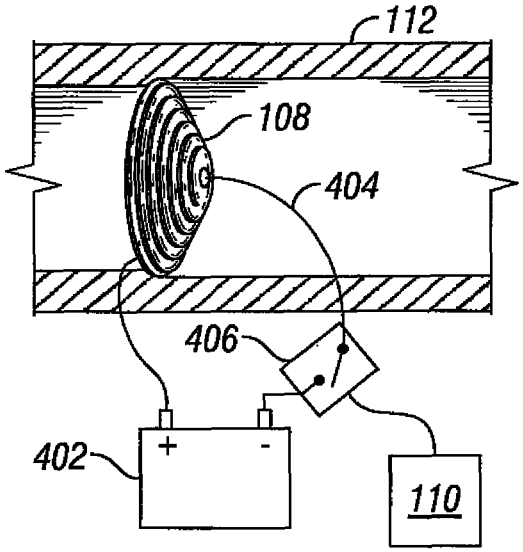
FIG. 4 is a schematic diagram of a conical spring check valve as a part of an electrically resistive circuit.

Referencing FIG. 4, an electrically resistive circuit 404 includes the helically wound spring of the conical spring check valve 108. A controller 110 controls and/or provides the electrical power 402 to the electrically resistive circuit 404, for example by manipulation of the switch 406, to control a temperature of the helically wound spring. In certain embodiments, the temperature of the helically wound spring is controlled to a value above a condensation temperature, preventing short-term (e.g. from sulfuric acid or other strong acids) and/or long-term (e.g. from oxidation in the presence of condensed water) degradation of the spring. The controller 110 may further provide electrical power to the electrically resistive circuit to periodically raise a temperature of the helically wound spring above a cleaning temperature—for example to a temperature that is determined to oxidize materials (e.g. soot, hydrocarbons, sulfates, etc.) that are likely to be deposited on the spring.

In certain embodiments, the conical spring check valve 108 includes a first function of an effective flow area versus an EGR flow rate (e.g. the nominal curve 502 illustrated in FIG. 5), and the controller 110 provides electrical power to the electrically resistive circuit to adjust a temperature of the helically wound spring and thereby adjust the conical spring check valve 108 to a second function of the effective flow area versus the EGR flow rate. In one example, the spring rate of the helically wound spring decreases as the temperature of the spring increases, and the controller 110 controls the conical spring check valve 108 to a higher effective flow area versus flow rate on the exemplary curve 508 by increasing the temperature of the helically wound spring. In another example, the spring rate of the helically wound spring increases as the temperature of the spring increases (e.g. some shape memory alloys have this response characteristic) and the controller 110 controls the conical spring check valve 108 to a lower effective flow area versus flow rate on the exemplary curve 506 by increasing the temperature of the helically wound spring.

The electrically resistive circuit 404 is connected to each end of the helically wound spring in the illustrative embodiment of FIG. 4. However, the connection areas to the helically wound spring are not limited. For example, the helically wound spring may include a pair of conductive elements with an insulating layer between and connected at or near the end of the spring such that the electrically resistive circuit 404 both enters and exits the helically wound spring at the base of the spring. Any other electrical connection is contemplated herein as long as a portion of the spring is included in the electrically resistive circuit 404 such that the spring can be heated sufficiently for the intended purpose in the specific embodiment (e.g. to avoid condensation, clean, and/or achieve the desired spring rate).

Figure 6:
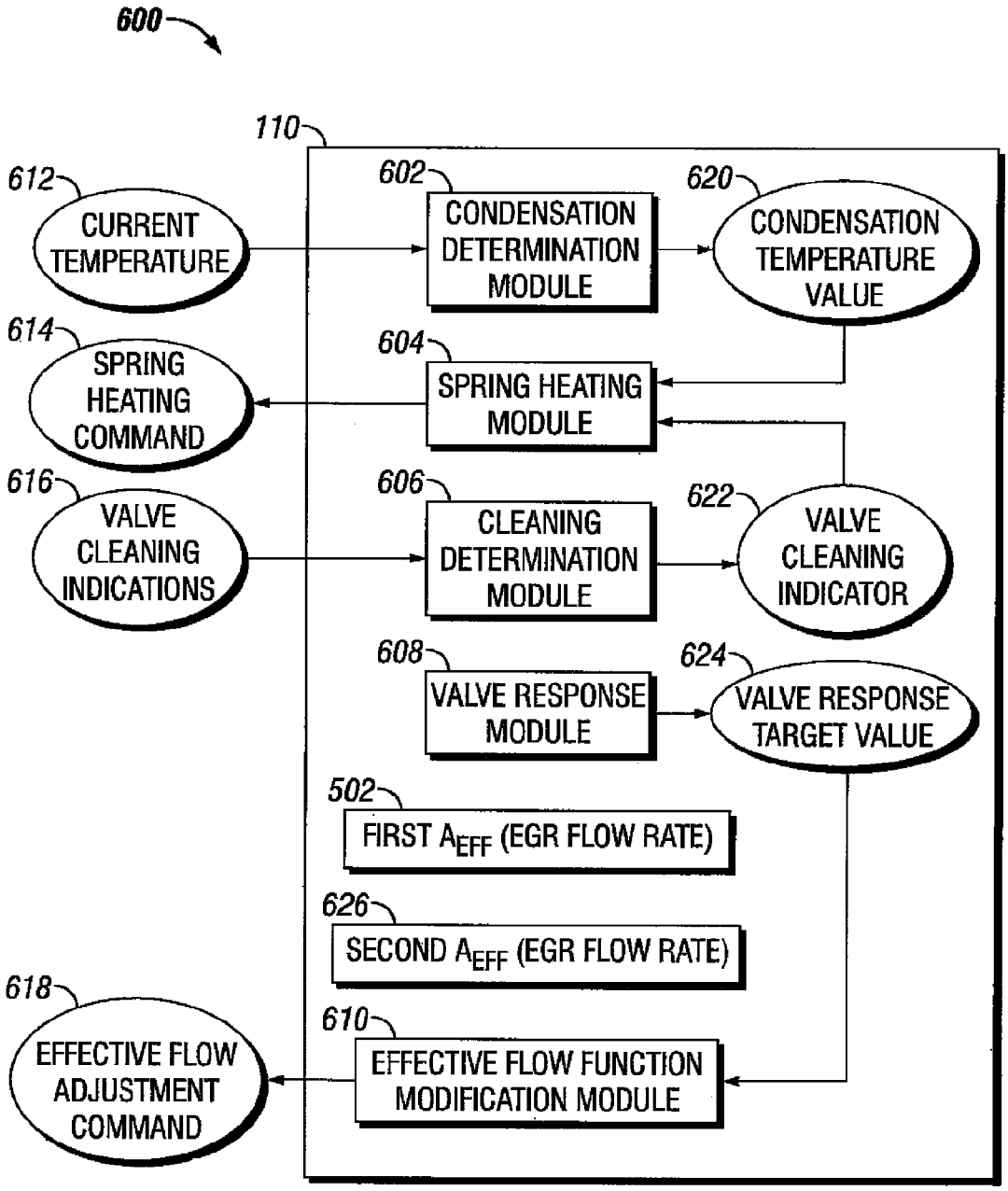
FIG. 6 is a schematic diagram of a processing subsystem having a controller for executing certain operations in relation to a conical spring check valve for controlling reverse flow.

FIG. 6 is an illustration of a processing subsystem 600 for performing certain operations for controlling reverse flow through a fluid conduit. The processing subsystem 600 includes a controller 110 having modules that execute certain operations for controlling the reverse flow through the fluid conduit. The controller 110 is shown as a single device to simplify description. However, the controller 110 may include multiple devices, distributed devices, some devices that are hardware and/or include a software component. Further, any data values illustrated may be stored on the controller 110 and/or communicated to the controller 110. The controller 110 may include devices that are physically remote from other components of the system but that are at least intermittently in communication with the system via network, datalink, internet, or other communication means.

The controller 110 includes modules structured to functionally execute operations for controlling reverse flow through a fluid conduit. The description herein includes the use of modules to highlight the functional independence of the features of the elements described. A module may be implemented as operations by software, hardware, or at least partially performed by a user or operator. In certain embodiments, modules represent software elements as a computer program encoded on a computer readable medium, wherein a computer performs the described operations when executing the computer program. A module may be a single device, distributed across devices, and/or a module may be grouped in whole or part with other modules or devices. The operations of any module may be performed wholly or partially in hardware, software, or by other modules. The presented organization of the modules is exemplary only, and other organizations that perform equivalent functions are contemplated herein.

The controller 110 includes a condensation determination module 602 that determines a condensation temperature value 620, and a spring heating module 604 that provides the spring heating command 614 to the power actuator in response to the condensation temperature value 620. In certain embodiments, the condensation determination module 602 may determine a current temperature 612 of the spring, and compare the current temperature 612 to the condensation temperature value 620, where the spring heating module 604 provides the spring heating command 614 in response to the current temperature 612 being lower than the condensation temperature value 620. In alternate embodiments, the controller 110 may track other system operating conditions and provide the spring heating command 614 selectively in response—for example only providing the spring heating command 614 when a flow rate through the fluid conduit 112 is below a threshold value.

In certain embodiments, the controller 110 includes a cleaning determination module 606 that determines a valve cleaning indicator 622, where the spring heating module 604 provides the spring heating command 614 to the power actuator in response to the valve cleaning indicator 622. The valve cleaning indicator 622 may be determined in response to valve cleaning indications 616, although the valve cleaning indicator 622 may also be determined without the valve cleaning indications 616—for example in an open loop schedule based on operating time, vehicle miles, or other parameters known in the art. Exemplary valve cleaning indications 616 include determining that the conical spring check valve is experiencing a reduced response (e.g. EGR flow is lower or less responsive than expected), or to determining that the conical spring check valve has experienced a condition indicating a cleaning event (e.g. an extended period in the presence of unburned hydrocarbons, excessive soot, and/or at low temperature). The illustrated operations are exemplary and non-limiting, and any other valve cleaning indications 616 or methods of determining a valve cleaning indicator 622 known in the art are contemplated herein.

In certain embodiments, the conical spring check valve includes a first function of an effective flow area versus an EGR flow rate 502, and the controller 110 includes a valve response module 608 that determines a valve response target value 624, and an effective flow function modification module 610 that provides an effective flow adjustment command 618 in response to the valve response target value 624. The first function of an effective flow area versus an EGR flow rate 502 may be a nominal effective flow area through the conical spring check valve in response to flow through the conical spring check valve. The valve response target value 624 may be a quantitative or qualitative description of a desired function of effective flow area of the conical spring check valve in response to flow through the conical spring check valve. For example, the valve response target value 624 may be a request for a specific function of effective flow area, a request for a lowest or highest available effective flow area versus flow rate, or a request for a specific state of an effective flow area versus flow rate adjuster (e.g. charged, energized, ON, etc.).

In certain embodiments, the system includes a valve restriction actuator that adjusts the conical spring check valve to a second function of the effective flow area versus the EGR flow rate 626 in response to the effective flow adjustment command 618. Additional or alternative embodiments of the system include the helically wound spring being a portion of an electrically resistive circuit, where the system further includes a power actuator that provides electrical power to the electrically resistive circuit to adjust a temperature of the helically wound spring, thereby adjusting the conical spring check valve to a second function of the effective flow area versus the EGR flow rate 626 in response to the effective flow adjustment command 618.

Yet another exemplary embodiment is an apparatus including an exhaust gas recirculation (EGR) conduit fluidly coupling an exhaust manifold for an internal combustion engine to an intake manifold of the internal combustion engine. The apparatus is described using an EGR conduit for clarity, but the apparatus may include any other type of engine related gaseous fluid conduit known in the art, including but not limited to any type of gaseous fluid conduit having at least a fraction of gases therein being combustion gases. The apparatus further includes a conical spring check valve disposed in the EGR conduit, the conical spring check valve including a helically wound spring having a number of turns of decreasing diameter. Each of the turns progresses axially in a normal flow direction of the EGR from a previous one of the turns, and each of the turns at least partially radially overlaps the previous one of the turns. In certain embodiments, the conical spring check valve includes a function of an effective flow area versus an EGR flow rate, and the apparatus further includes a means for adjusting the function of the effective flow area versus the EGR flow rate.

One example of a means for adjusting the function of the effective flow area versus the EGR flow rate (or the effective flow area versus a flow rate through another engine related gaseous fluid conduit) includes an actuator operatively coupled to the helically wound spring that applies a force against the helically wound spring to change the function of the effective flow area versus the EGR flow rate. The actuator may hold the spring at a fixed position, apply an opening force to the spring to increase the effective flow area, or apply a closing force to the spring to provide a decreased or zero effective flow area.

Another example of a means for adjusting the function of the effective flow area versus the EGR flow rate includes a power supply electrically connected to the helically wound spring, where the spring is an electrically resistive material that increases temperature in response to an electrical current passing through the spring. The helically wound spring changes the effective flow area versus the EGR flow rate in response to temperature changes of the helically wound spring. In certain embodiments, the spring rate of the helically wound spring decreases with an increasing temperature, and a controller controls the spring to a fixed temperature in response to a desired flow condition (e.g. a "high" temperature where low flow resistance is desired, or a "low" temperature where high flow resistance is desired or where flow resistance is not important and energy savings are the predominant concern), applies power in response to a desired flow condition (e.g. a simple power-on where low flow resistance is desired) and/or controls the spring to a scheduled temperature to provide a scheduled function of effective flow area versus the EGR flow rate.

In another example of a means for adjusting the function of the effective flow area versus the EGR flow rate includes the helically wound spring having a spring rate that increases with increasing temperature. An exemplary, non-limiting material that increases spring rate with increasing temperature is a shape memory alloy (e.g. a nickel-titanium alloy structured as a shape memory alloy). The controller applies power in response to a desired flow condition, and/or to control the spring rate to provide a scheduled function of the effective flow area versus the EGR flow rate.

As is evident from the figures and text presented above, a variety of embodiments according to the present invention are contemplated.

One exemplary embodiment is an apparatus including an engine related gaseous fluid conduit that may be an exhaust gas recirculation (EGR) conduit fluidly coupling an exhaust manifold for an internal combustion engine to an intake manifold of the internal combustion engine. The apparatus further includes a conical spring check valve disposed in the EGR conduit, the conical spring check valve having a helically wound spring having a number of turns of decreasing diameter. Each of the turns progresses axially in a normal flow direction of the EGR from a previous one of the turns, and each of the turns at least partially radially overlaps the previous one of the turns. The conical spring check valve may be positioned on an upstream side of an EGR cooler, and may further be downstream of an EGR valve. Alternatively, the conical spring check valve may be positioned downstream of an EGR cooler, and may further be downstream of an EGR valve.

In certain embodiments, the helically wound spring is a portion of an electrically resistive circuit. The apparatus further includes a controller that provides electrical power to the electrically resistive circuit to maintain a temperature of the helically wound spring above a condensation temperature. The controller may further provide electrical power to the electrically resistive circuit to periodically raise a temperature of the helically wound spring above a cleaning temperature. In certain embodiments, the conical spring check valve includes a first function of an effective flow area versus an EGR flow rate, and the controller provides electrical power to the electrically resistive circuit to adjust a temperature of the helically wound spring and thereby adjust the conical spring check valve to a second function of the effective flow area versus the EGR flow rate.

In certain embodiments, the conical spring check valve includes a first function of an effective flow area versus an EGR flow rate, and the apparatus further includes a valve restriction actuator structured to adjust the conical spring check valve to a second function of the effective flow area versus the EGR flow rate. The valve restriction actuator further includes, in certain embodiments, an actuator that provides an axial force to the helically wound spring.

Another exemplary embodiment is a system including an internal combustion engine receiving intake air from an intake manifold and providing exhaust gases to an exhaust manifold. The system further includes an exhaust gas recirculation (EGR) conduit fluidly coupling the exhaust manifold to the intake manifold, and a conical spring check valve disposed in the EGR conduit. The conical spring check valve further includes a helically wound spring having a plurality of turns of decreasing diameter, where each of the turns progresses axially in a normal flow direction of the EGR from a previous one of the turns, and where each of the turns at least partially radially overlaps the previous one of the turns.

In certain embodiments, the helically wound spring includes a portion of an electrically resistive circuit. The system further includes a power actuator that provides electrical power to the electrically resistive circuit in response to a spring heating command. Certain further embodiments include a controller having a plurality of modules structured to functionally execute operations of the controller. The controller includes a condensation determination module that determines a condensation temperature value, and a spring heating module that provides the spring heating command to the power actuator in response to the condensation temperature value. Further embodiments of the controller include a cleaning determination module that determines a valve cleaning indicator, and a spring heating module that provides the spring heating command to the power actuator in response to the valve cleaning indicator.

In certain embodiments, the conical spring check valve includes a first function of an effective flow area versus an EGR flow rate, and the system further includes a controller having a valve response module that determines a valve response target value, and an effective flow function modification module that provides an effective flow adjustment command in response to the valve response target value. Certain embodiments further include a valve restriction actuator that adjusts the conical spring check valve to a second function of the effective flow area versus the EGR flow rate in response to the effective flow adjustment command. Additional or alternative embodiments of the system include the helically wound spring including a portion of an electrically resistive circuit, where the system further includes a power actuator that provides electrical power to the electrically resistive circuit to adjust a temperature of the helically wound spring and thereby adjusts the conical spring check valve to a second function of the effective flow area versus the EGR flow rate in response to the effective flow adjustment command.

Yet another exemplary embodiment is an apparatus including an exhaust gas recirculation (EGR) conduit fluidly coupling an exhaust manifold for an internal combustion engine to an intake manifold of the internal combustion engine. The apparatus further includes a conical spring check valve disposed in the EGR conduit, the conical spring check valve including a helically wound spring having a number of turns of decreasing diameter. Each of the turns progresses axially in a normal flow direction of the EGR from a previous one of the turns, and each of the turns at least partially radially overlaps the previous one of the turns. In certain embodiments, the conical spring check valve includes a function of an effective flow area versus an EGR flow rate, and the apparatus further includes a means for adjusting the function of the effective flow area versus the EGR flow rate.

While the invention has been illustrated and described in detail in the drawings and foregoing description, the same is to be considered as illustrative and not restrictive in character, it being understood that only certain exemplary embodiments have been shown and described and that all changes and modifications that come within the spirit of the inventions are desired to be protected. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

What is claimed is:

1. An apparatus, comprising:

an engine related gaseous fluid conduit;

a conical spring check valve disposed in the engine related gaseous fluid conduit, comprising:

a helically wound spring comprising a plurality of turns of decreasing diameter; each of the plurality of turns progresses axially in a normal flow direction of the engine related gaseous fluid conduit from a previous one of the plurality of turns, and wherein each of the plurality of turns partially radially overlaps the previous one of the plurality of turns, wherein the helically wound spring comprises a portion of an electrically resistive circuit.

2. The apparatus of claim 1, wherein the engine related gaseous fluid conduit comprises an exhaust gas recirculation (EGR) conduit fluidly coupling an exhaust manifold for an internal combustion engine to an intake manifold of the internal combustion engine.

3. The apparatus of claim 2, wherein the conical spring check valve is positioned on an upstream side of an EGR cooler.

4. The apparatus of claim 3, wherein the conical spring check valve is positioned downstream of an EGR valve.

5. The apparatus of claim 2, wherein the conical spring check valve is positioned downstream of an EGR cooler.

6. The apparatus of claim 5, wherein the conical spring check valve is positioned downstream of an EGR valve.

7. The apparatus of claim 2, wherein the conical spring check valve comprises a first function of an effective flow area versus an EGR flow rate, the apparatus further comprising a valve restriction actuator structured to adjust the conical spring check valve to a second function of the effective flow area versus the EGR flow rate.

8. The apparatus of claim 7, wherein the valve restriction actuator comprises an actuator that provides an axial force to the helically wound spring.

9. The apparatus of claim 2, wherein the conical spring check valve comprises a first function of an effective flow area versus an EGR flow rate, the apparatus further comprising a controller structured to provide electrical power to the electrically resistive circuit to adjust a temperature of the helically wound spring and thereby adjust the conical spring check valve to a second function of the effective flow area versus the EGR flow rate.

10. The apparatus of claim 1, further comprising a controller structured to provide electrical power to the electrically resistive circuit to maintain a temperature of the helically wound spring above a condensation temperature.

11. The apparatus of claim 1, further comprising a controller structured to provide electrical power to the electrically resistive circuit to periodically raise a temperature of the helically wound spring above a cleaning temperature.

12. A system, comprising:

an internal combustion engine including an intake manifold adapted to receive intake air and an exhaust manifold adapted to receive exhaust gas;

an exhaust gas recirculation (EGR) conduit fluidly coupling the exhaust manifold to the intake manifold;

a conical spring check valve disposed in the EGR conduit, the conical spring check valve comprising:

a helically wound spring including a plurality of turns of decreasing diameter; and wherein each of the plurality of turns progresses axially in a normal flow direction of the EGR from a previous one of the plurality of turns, and wherein each of the plurality of turns at least partially radially overlaps the previous one of the plurality of turns, and wherein the helically wound spring comprises a portion of an electrically resistive circuit.

13. The system of claim 12, further comprising a power actuator structured to provide electrical power to the electrically resistive circuit in response to a spring heating command.

14. The system of claim 13, further comprising a controller including:

a condensation determination module structured to determine a condensation temperature value; and a spring heating module structured to provide the spring heating command to the power actuator in response to the condensation temperature value.

15. The system of claim 13, further comprising a controller including:

a cleaning determination module structured to determine a valve cleaning indicator; and a spring heating module structured to provide the spring heating command to the power actuator in response to the valve cleaning indicator.

16. The system of claim 12, wherein the conical spring check valve comprises a first function of an effective flow area versus an EGR flow rate, the system further comprising a controller including:

a valve response module structured to determine a valve response target value; and an effective flow function modification module structured to provide an effective flow adjustment command in response to the valve response target value.

17. The system of claim 16, further comprising a valve restriction actuator structured to adjust the conical spring check valve to a second function of the effective flow area versus the EGR flow rate in response to the effective flow adjustment command.

18. The system of claim 16, the system further comprising a power actuator structured to provide electrical power to the electrically resistive circuit to adjust a temperature of the helically wound spring and thereby adjust the conical spring check valve to a second function of the effective flow area versus the EGR flow rate in response to the effective flow adjustment command.

19. An apparatus, comprising:

an exhaust gas recirculation (EGR) conduit fluidly coupling an exhaust manifold for an internal combustion engine to an intake manifold of the internal combustion engine;

a conical spring check valve disposed in the EGR conduit, the conical spring check valve comprising:

a helically wound spring comprising a plurality of turns of decreasing diameter;

wherein each of the plurality of turns progresses axially in a normal flow direction of the EGR from a previous one of the plurality of turns, and wherein each of the plurality of turns at least partially radially overlaps the previous one of the plurality of turns; and wherein the conical spring check valve comprises a function of an effective flow area versus an EGR flow rate, wherein the conical spring check valve comprises a portion of an electrically resistive circuit operable to adjust the function of the effective flow area versus the EGR flow rate.

* * * * *